US008221152B2

(12) United States Patent
Tracy et al.

(10) Patent No.: US 8,221,152 B2
(45) Date of Patent: Jul. 17, 2012

(54) CABLE MANAGEMENT SYSTEM AND METHOD

(75) Inventors: Mark S. Tracy, Tomball, TX (US); Paul J. Doczy, Cypress, TX (US); Jonathan R. Harris, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 946 days.

(21) Appl. No.: 11/786,122

(22) Filed: Apr. 11, 2007

(65) Prior Publication Data

US 2008/0254671 A1 Oct. 16, 2008

(51) Int. Cl.
*H01R 13/62* (2006.01)

(52) U.S. Cl. ..... 439/371

(58) Field of Classification Search ..... 439/367, 439/368–371, 76.1; 361/681
See application file for complete search history.

(56) References Cited

U.S. PATENT DOCUMENTS

| | | | | |
|---|---|---|---|---|
| 4,981,438 | A * | 1/1991 | Bekhiet | 439/76.1 |
| 4,986,763 | A | 1/1991 | Boyle | |
| 5,237,488 | A | 8/1993 | Moser et al. | |
| 5,390,075 | A | 2/1995 | English et al. | |
| 5,394,297 | A | 2/1995 | Toedter | |
| 5,498,165 | A | 3/1996 | Tseng | |
| 5,561,269 | A * | 10/1996 | Robertson et al. | 174/92 |
| 5,572,769 | A | 11/1996 | Spechts et al. | |
| 5,600,098 | A | 2/1997 | Kazaks | |
| 5,751,544 | A | 5/1998 | Song | |
| 6,181,284 | B1 | 1/2001 | Madsen et al. | |
| 6,312,278 | B1 | 11/2001 | Prior | |
| 6,484,016 | B1 | 11/2002 | Cheon | |
| 6,532,653 | B1 | 3/2003 | Alpert | |
| 6,604,966 | B1 | 8/2003 | Hayes et al. | |
| 6,642,892 | B2 | 11/2003 | Masaki et al. | |
| 6,790,094 | B1 * | 9/2004 | Bergmann et al. | 439/653 |
| 2002/0021551 | A1 * | 2/2002 | Kashiwagi | 361/683 |
| 2002/0100807 | A1 | 8/2002 | Minaguchi et al. | |
| 2004/0105230 | A1 | 6/2004 | Lin | |
| 2004/0109286 | A1 * | 6/2004 | Shin | 361/683 |

FOREIGN PATENT DOCUMENTS

| | | |
|---|---|---|
| JP | 11219233 | 8/1999 |
| KR | 20020057597 A | 7/2002 |
| KR | 20060020743 A | 3/2006 |

OTHER PUBLICATIONS

PCT Written Opinion and Search Report mailed Jul. 1, 2008 (7 pages).
Translation of DE Office Action dated Dec. 11, 2009, pp. 4.
Intellectual Property Office, Combined Search and Examination Report under Sections 17 and 18(4), Application No. GB1115831.8, date of mailing Oct. 3, 2011.
CN Office Action, Appln No. 200880011715.X, date of mailing Dec. 16, 2011, 6 p.
Translation of CN Office Action, Appln No. 200880011715.X, date of mailing Dec. 16, 2011, 11 p.

* cited by examiner

*Primary Examiner* — Ross Gushi

(57) ABSTRACT

A cable management system comprises an electronic device having a display member movably coupled to a base member, and a printed circuit board (PCB) interconnect configured to electrically couple at least one cable received by the interconnect from a device in the display member with at least one cable received by the interconnect from a device in the base member.

20 Claims, 3 Drawing Sheets

CABLE MANAGEMENT SYSTEM AND METHOD

BACKGROUND

Some types of electronic devices, such as notebook computers, gaming devices, media players, etc., have a display member coupled to a base member by a hinge or other type of device to enable rotational and/or variable movement of the display member relative to the base member. These electronic devices generally have a number of wires or cables extending from the base member to the display member to connect various devices in the display member to various devices in the base member such as wires/cables for connecting a display screen in the display member to a motherboard in the base member, an antenna in the display member with a wireless card in the base member, etc. Thus, because of the quantity and/or different types of wires/cables extending between the base member and the display member, assembly and disassembly of the electronic device (e.g., coupling the display member to and/or detaching the display member from the base member) is difficult and time-consuming.

DETAILED DESCRIPTION OF THE DRAWINGS

Embodiments and the advantages thereof are best understood by referring to FIGS. 1-5 of the drawings, like numerals being used for like and corresponding parts of the various drawings.

Figure 1:
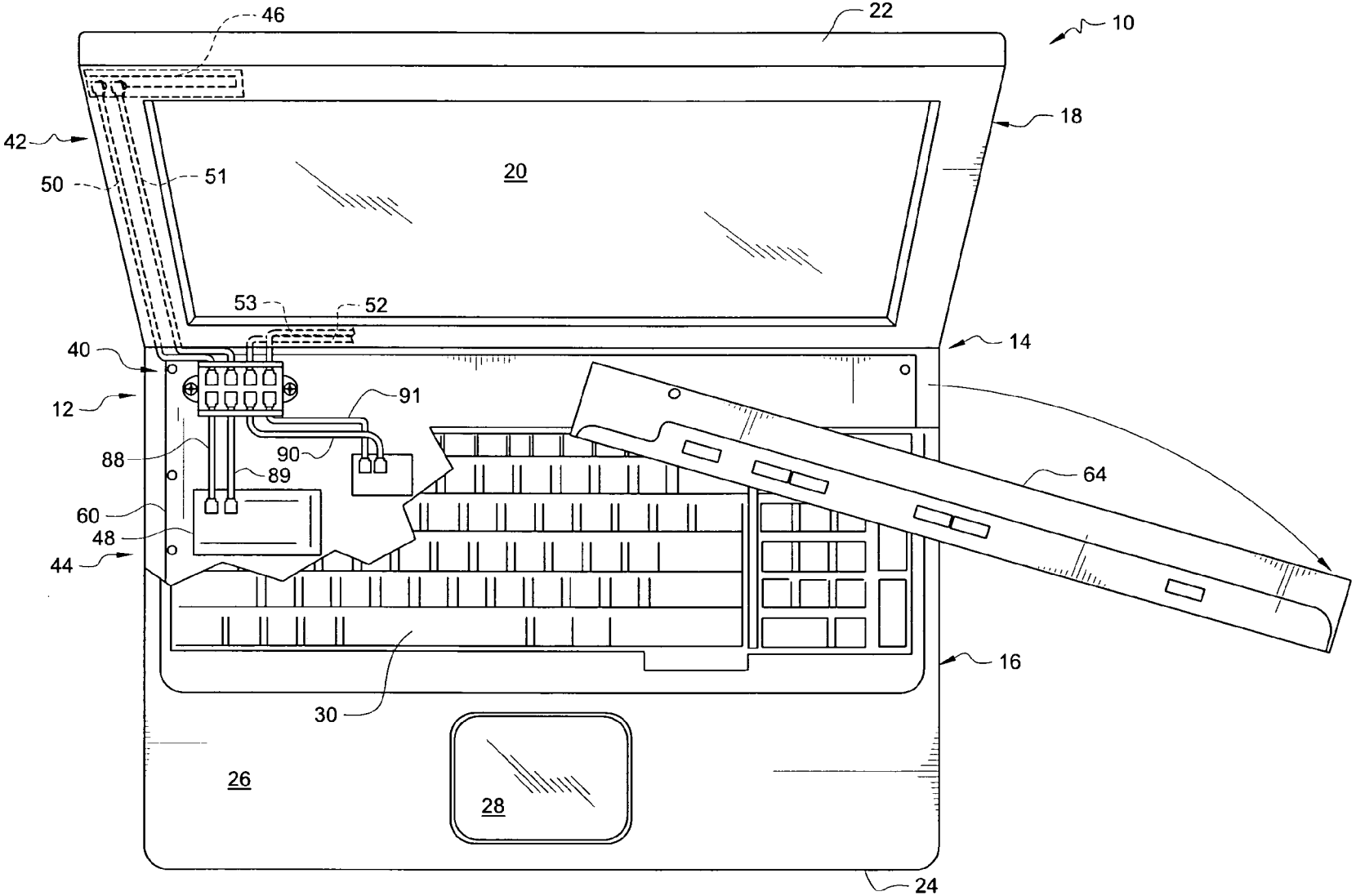
FIG. 1 is a diagram illustrating a computer device in which an embodiment of a cable management system is employed to advantage.

FIG. 1 is a diagram illustrating an electronic device 10 in which an embodiment of a cable management system 12 is employed to advantage. In the embodiment illustrated in FIG. 1, electronic device 10 comprises a notebook computer 14 having a base member 16 rotatably coupled to a display member 18 having a display screen 20. However, it should be understood that electronic device 10 may comprise other types of devices such as, but not limited to, a telephonic device, personal digital assistant, gaming device, media player or other device having a display member coupled to a base member. In the embodiment illustrated in FIG. 1, display member 18 comprises a housing 22 surrounding and/or otherwise supporting display screen 20, and base member 16 comprises a housing 24. In the embodiment illustrated in FIG. 1, base member 16 comprises a working surface 26 defined by an upper portion of housing 24 generally positioned toward a user to facilitate use of various functions of electronic device 10. For example, in FIG. 1, working surface 26 comprises a touch pad 28 and a keyboard 30. However, it should be understood that other components of electronic device 10 may be disposed on working surface 26 or elsewhere on electronic device 10.

In the embodiment illustrated in FIG. 1, system 12 comprises an interconnect manifold 40 for electrically and/or communicatively coupling one or more devices 42 disposed in display member 18 to one or more devices 44 disposed in base member 16. Devices 42 and 44 may comprise any type of device located and/or otherwise disposed in respective display member 18 and base member 16. For example, device 42 may comprise display screen 20, an antenna 46 or other type of element disposed in display member 18, and device 44 may comprise a wireless card 48, a motherboard 60 or other type of element disposed in base member 16. In the embodiment illustrated in FIG. 1, interconnect manifold 40 is configured to electrically and/or communicatively couple cables and/or wires connected to one or more devices 42 disposed in display member 18 to corresponding cables connected to one or more devices 44 disposed in base member 16. For example, in the embodiment illustrated in FIG. 1, four cables 50-53 are received by interconnect manifold 40 from devices 42 of display member 18 and four cables 88-91 are received by interconnect manifold 40 from devices 44 in base member 16. In FIG. 1, cables 50 and 51 are coupled to antenna 46 and extend to interconnect manifold 40, and cables 88 and 89 extend from interconnect manifold to wireless card 48. Interconnect manifold 40 is used to electrically and/or communicatively couple cables 50 and 51 to cables 88 and 89, thereby coupling antenna 46 to wireless card 48. However, it should be understood that interconnect manifold 40 may be used to couple a greater or fewer quantity of cables between display member 18 and base member 16. It should also be understood that interconnect manifold 40 may be used to connect other types of devices 42 to other types of devices 44. A "cable" (e.g., cables 50-53 and 88-91) may comprise any type of conductive and/or communicative medium.

In the embodiment illustrated in FIG. 1, interconnect manifold 40 is disposed in base member 16. However, it should be understood that interconnect manifold 40 may be otherwise located. For example, in some embodiments, instead of having interconnect manifold 40 located in base member 16, interconnect manifold 40 may be located in display member 18. Further, in some embodiments, an interconnect manifold 40 may be located in both display member 18 and base member 16. Additionally, in FIG. 1, a single interconnect manifold 40 is illustrated. However, it should be understood that multiple interconnect manifolds 40 may be used.

In some embodiments, interconnect manifold 40 comprises a printed circuit board (PCB) interconnect manifold 40 such that conductive traces located on PCB interconnect manifold 40 are used to electrically and/or communicatively couple various connections between cables received from display member 18 with cables received from base member 16. However, it should be understood that other types of devices may be used to form interconnect manifold 40. In FIG. 1, interconnect manifold 40 is illustrated as being disposed on and/or otherwise mounted to motherboard 60. However, it should be understood that interconnect manifold 40 may be otherwise located.

In FIG. 1, working surface 26 comprises a removable panel 64 to facilitate access to interconnect manifold 40. For example, in the embodiment illustrated in FIG. 1, panel 64 is located between keyboard 30 and a portion of base member 16 located near display member 18 (e.g., near a coupling location of base member 16 to display member 18) such that, in response to removal of panel 64 from base member 16, interconnect manifold 40 is readily accessible to enable ready connection/disconnection of cables relative to manifold interconnect 40, thereby facilitating easy and/or ready connection/disconnection of display member 18 relative to base member 16. For example, if display member 18 is to be disconnected and/or detached from base member 16, panel 64 may be removed to provide access to interconnect manifold 40 to facilitate disconnecting of cables extending from display member 18 to interconnect manifold 40. Thus, embodiments of system 12 facilitate ready removal of display member 18 from base member 16 without requiring extensive disassembly of base member 16 that would otherwise be required to obtain access to various locations in base member in order to disconnect cables from various locations/components located in base member 16 (e.g., disassembly of base member 16 in order to access wireless card 48, motherboard 60, various locations on motherboard 60, or other components/locations in base member 16). It should be understood that system 12 also facilitates easier connecting of display member 18 to base member 16 (e.g., by enabling cables from display member to be coupled to interconnect manifold 40 instead of having to route each cable extending from display member 18 to its corresponding destination in base member 16).

Figure 2:
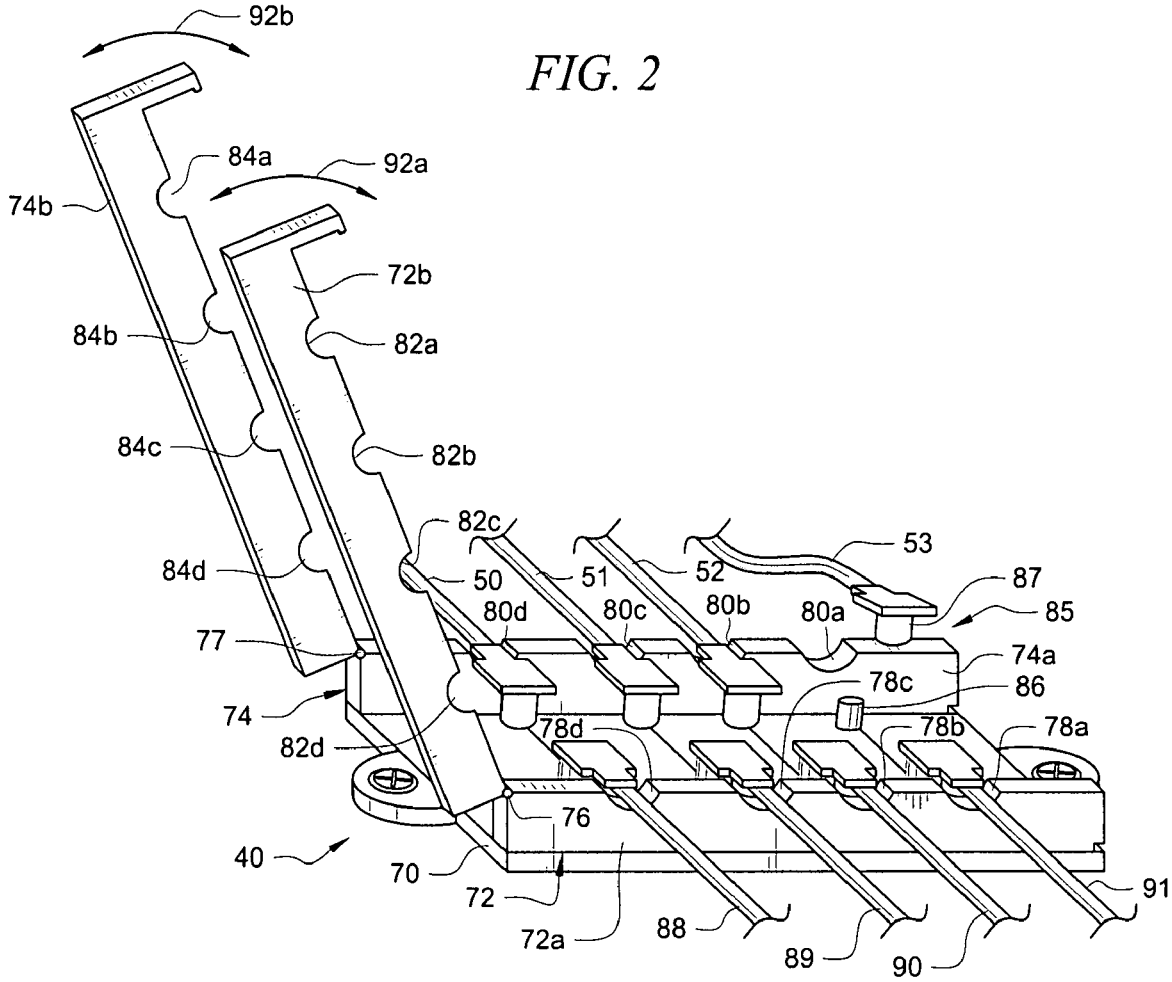
FIG. 2 is a diagram illustrating an embodiment of an interconnect manifold of the cable management system of FIG. 1 in an open position.
Figure 3:
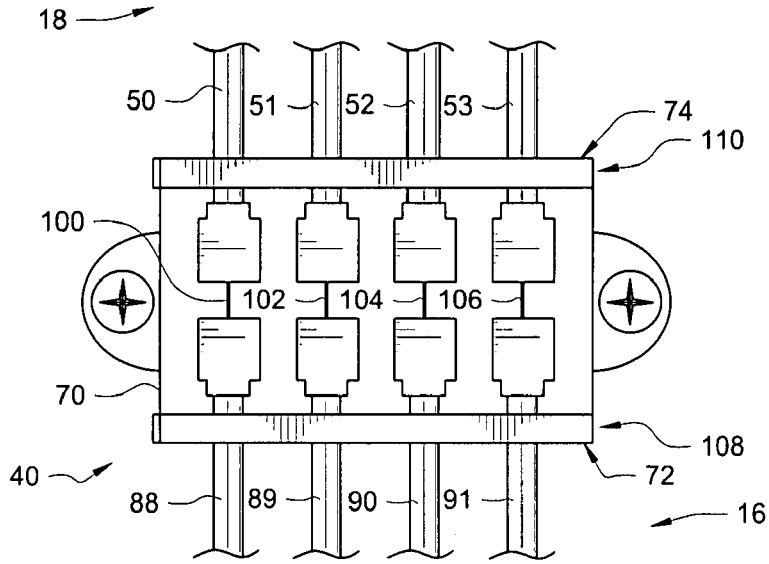
FIG. 3 is a diagram illustrating a side view of the interconnect manifold of FIG. 2 in a closed position.

FIG. 2 is a diagram illustrating an enlarged view of interconnect manifold 40 of FIG. 1 in an open position, and FIG. 3 is a diagram illustrating an enlarged top view of interconnect manifold 40 illustrated in FIG. 2 in a closed position. In the embodiment illustrated in FIGS. 2 and 3, interconnect manifold 40 comprises a printed circuit board 70 having a pair of strain relief elements 72 and 74 coupled thereto. Each of strain relief elements 72 and 74 comprises a base element 72*a* and 74*a* coupled to a hinged element 72*b* and 74*b*, respectively. Hinged elements 72*b* and 74*b* are rotatably coupled via hinges 76 and 77 to base elements 72*a* and 74*a*, respectively. Each of base elements 72*a* and 74*a* comprise arcuate recesses 78*a*-78*d* and 80*a*-80*d*, respectively, that are positioned to align with arcuate recesses 82*a*-*d* and 84*a*-*d* of hinged elements 72*b* and 74*b*, respectively, to form openings for receiving cables therethrough. For example, in the embodiment illustrated in FIGS. 2 and 3, interconnect manifold 40 is illustrated as receiving cables 50-53 from display member 18 and cables 88-91 from base member 16. Recesses 78 and 82 cooperate to form openings for receiving cables 88-91, and recesses 80 and 84 cooperate to form openings for receiving cables 50-53. In operation, hinged elements 72*b* and 74*b* are rotatable in the directions indicated by arrows 92*a* and 92*b* relative to base elements 72*a* and 74*a*, respectively, to facilitate opening and closing of hinged elements 72*b* and 74*b* relative to respective base elements 72*a* and 74*b*. Thus, in operation, hinged elements 72*b* and 74*b* are rotatable relative to base elements 72*a* and 74*a* to a closed position relative to base elements 72*a* and 74*a* to retain cables 88-91 and 50-53 in interconnect manifold 40 by applying a clamping force to cables 88-91 and 50-53. However, it should be understood that a retention and/or strain relief force may be otherwise applied to cables connected to interconnect manifold 40.

In the embodiment illustrated in FIGS. 2 and 3, conductive traces 100, 102, 104 and 106 are disposed on printed circuit board 70 to electrically and/or communicatively couple cables 50-53 to cables 88-91, respectively. For example, in the embodiment illustrated in FIGS. 2 and 3, cables 88-91 are received from base member 16 on a side 108 of interconnect manifold 40, and cables 50-53 are received from display member 18 on a side 110 of interconnect manifold 40. Conductive traces 100, 102, 104 and 106 are used to electrically and/or communicatively couple cables 88-91 to respective cables 50-53. In the embodiment illustrated in FIGS. 2 and 3, conductive traces 100, 102, 104 and 106 are configured to couple cable connection locations on interconnection manifold that are directly across from each other (e.g., from the connection location of cable 88 to the connection location of cable 50). However, it should be understood that conductive traces may be otherwise formed on printed circuit board 70 to accommodate coupling of desired connection locations of interconnect manifold 40 (e.g., a conductive trace may be disposed on printed circuit board 70 to facilitate coupling of cable 88 to a connection location corresponding to the illustrated position of cable 53).

In the embodiment illustrated in FIGS. 2 and 3, cables 50-53 and 88-91 and interconnect manifold 40 are configured having a quick-connect/disconnect assembly 85 to facilitate easy and/or quick engagement and/or disengagement therebetween. Quick-connect/disconnect assembly 85 is described in connection with cable 53 and its connection to interconnect manifold 40; however, it should be understood that quick-connect/disconnect assembly 85 may be used for each cable connection to interconnect manifold 40. Referring to FIG. 2, quick-connect/disconnect assembly 85 comprises a connector post 86 disposed on interconnect manifold 40 and a socket 87 disposed at an end of cable 53 to enable slideable engagement of socket 87 with post 86. However, it should be understood that other types of quick-connect/disconnect elements may be used (e.g., push-on, slip-on, screw-on, etc.). Further, it should be understood that cable connection methods other than quick-connect/disconnect may be used.

Figure 4:
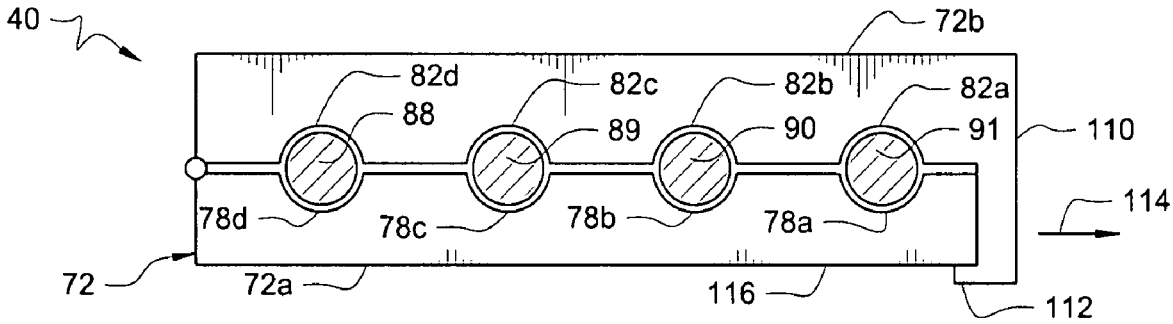
FIG. 4 is a diagram illustrating a side view of the interconnect manifold of FIGS. 2 and 3 in a closed position.
Figure 5:
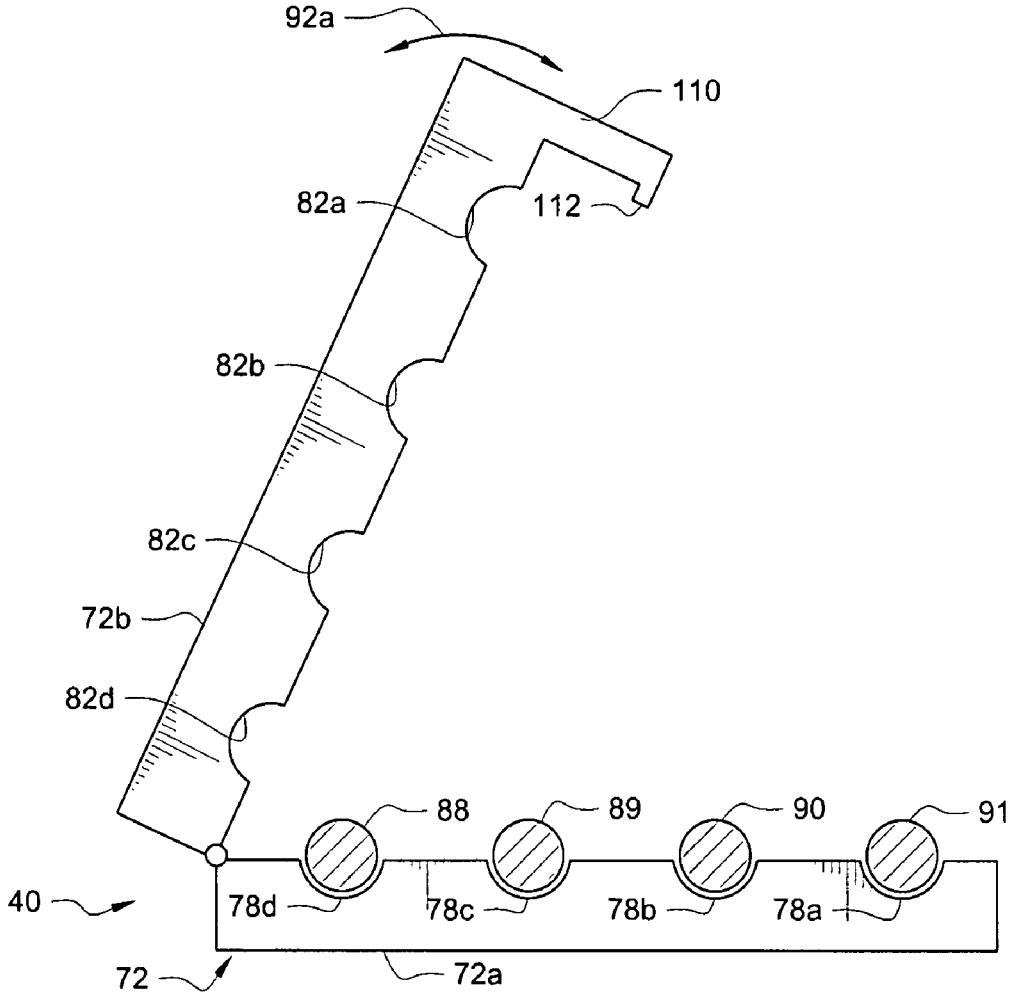
FIG. 5 is a diagram illustrating a side view of the interconnect manifold of FIGS. 2-4 in a closed position.

FIG. 4 is a diagram illustrating a side view of interconnect manifold 40 illustrated in FIGS. 2 and 3 in a closed position, and FIG. 5 is a side view illustrating interconnect manifold 40 of FIGS. 2-4 in an open position. In FIGS. 4 and 5, the following description is made in connection with relief element 72; however, it should be understood that relief element 74 is similarly configured and/or operational. In the embodiment illustrated in FIGS. 4 and 5, hinged element 72*b* comprises an extension member 110 having a locking tab 112 located thereon. In some embodiments, relief element 72 is configured from a material having some level of flexibility (e.g., plastic) such that extension member 110 may be moved or flexed slightly outwardly in the direction indicated by arrow 114 in FIG. 4 to facilitate locking of relief element 72. For example, in some embodiments, hinged element 72*b* may be positioned in a closed and/or locked position relative to base member 72*a* by rotating hinged element 72*b* in the direction indicated by arrow 92*a* (FIG. 5) and flexing extension member 110 slightly outwardly in the direction indicated by arrow 114 to facilitate locating locking element 112 on a side 116 of base element 72*a* opposite a location of hinged element 72*b*, thereby locking hinged element 72*b* relative to base element 72*a*. To open and/or unlock relief element 72, extension member is movable and/or slightly flexed outwardly in the direction of arrow 114 to facilitate clearing of locking tab 112 relative to base element 72*a* and rotating hinged element 72*b* away from base element 72*a*. Thus, in operation, in a closed or locked position, relief element 72 provides a clamping force to cables 88-91 disposed in and/or otherwise extending through strain relief element 72 (for ease of illustration and description, cables 88-91 and strain relief element 72 are illustrated with slight openings relative thereto in FIGS. 4 and 5; however, it should be understood that strain relief 72 is configured to apply a clamping force to cables 88-91 when in a closed and locked position), thereby resisting cables 88-91 from being pulled away and/or inadvertently disconnected from interconnect manifold 40.

Thus, embodiments of system 12 facilitate ready engagement and disengagement of display member 18 relative to base member 16 without requiring extensive disassembly of display member 18 and/or base member 16 that would otherwise be necessary in order to disconnect cables and/or reestablish wired connections between various components in display member 18 with corresponding components in base member 16. Further, embodiments of system 12 provide a strain relief mechanism to substantially prevent and/or eliminate inadvertent disengagement of cables between display member 18 and base member 16 that may otherwise result in response to movement of display member 18 relative to base member 16 or otherwise.

What is claimed is:

1. A cable management system, comprising:

an electronic device having a display member movably coupled to a base member; and a printed circuit board (PCB) interconnect configured to electrically couple a plurality of cables received by the PCB interconnect from at least one device in the display member with a plurality of cables received by the PCB interconnect from at least one device in the base member, wherein the PCB interconnect comprises at least one hinge-based retention member.

2. The system of claim 1, wherein the PCB interconnect is disposed in the base member.

3. The system of claim 1, wherein the PCB interconnect is disposed on a motherboard located in the base member.

4. The system of claim 1, wherein the PCB interconnect is configured to apply a retention force to at least one of the received cables.

5. The system of claim 1, wherein the at least one device in the display member comprises an antenna, and the at least one device in the base member comprises a wireless card.

6. The system of claim 1, wherein the PCB interconnect is configured to electrically couple the plurality of cables received by the PCB interconnect from the at least one device in the display member with the plurality of cables received by the PCB interconnect from the at least one device in the base member using conductive traces on the PCB interconnect.

7. The system of claim 1, wherein the PCB interconnect is configured to electrically couple the plurality of cables received by the PCB interconnect from the at least one device in the display member with the plurality of cables received by the PCB interconnect from the at least one device in the base member using cable connection locations all provided on one side of the PCB interconnect.

8. The system of claim 1, wherein the electronic device comprises a notebook computer having the display member rotatably coupled to the base member.

9. A cable management system, comprising:

an electronic device having a display member movably coupled to a base member; and a printed circuit board (PCB) interconnect configured to electrically couple at least one cable received by the PCB interconnect from a device in the display member with at least one cable received by the PCB interconnect from a device in the base member, the PCB interconnect comprising a strain relief element releasably couplable to at least one of the received cables, wherein the strain relief element comprises a hinged element configured to rotate into a clamping position relative to the at least one of the received cables.

10. The system of claim 9, wherein the PCB interconnect is disposed beneath a removable panel disposed on a working surface of the base member.

11. The system of claim 9, wherein the device in the display member comprises an antenna, and the device in the base member comprises a wireless card.

12. The system of claim 9, wherein the PCB interconnect comprises a conductive trace to electrically couple the at least one cable received by the PCB interconnect from the device in the display member with the at least one cable received by the PCB interconnect from the device in the base member.

13. The system of claim 9, wherein the PCB interconnect comprises cable connection locations all provided on one side of the PCB interconnect to electrically couple the at least one cable received by the PCB interconnect from the device in the display member with the at least one cable received by the PCB interconnect from the device in the base member.

14. The system of claim 9, wherein the electronic device comprises a notebook computer having the display member rotatably coupled to the base member.

15. A cable management system, comprising:

an electronic device having a display member movably coupled to a base member; and a printed circuit board (PCB) interconnect disposed in the base member and configured to electrically couple, using conductive traces on the PCB interconnect, a plurality of cables received by the PCB interconnect from at least one device in the display member with a plurality of cables received by the PCB interconnect from at least one device in the base member.

16. The system of claim 15, wherein the PCB interconnect is accessible via a removable panel disposed on a working surface of the base member.

17. The system of claim 15, wherein the at least one device in the display member comprises an antenna, and the at least one device in the base member comprises a wireless card.

18. The system of claim 17, wherein the PCB interconnect comprises at least one hinge-based retention member.

19. The system of claim 15, wherein the PCB interconnect is disposed on a motherboard located in the base member.

20. The system of claim 15, wherein the electronic device comprises a notebook computer having the display member rotatably coupled to the base member.

* * * * *